US009217563B2

(12) United States Patent
Lumetta

(10) Patent No.: US 9,217,563 B2
(45) Date of Patent: Dec. 22, 2015

(54) LED LIGHTING ASSEMBLY HAVING ELECTRICALLY CONDUCTIVE HEAT SINK FOR PROVIDING POWER DIRECTLY TO AN LED LIGHT SOURCE

(75) Inventor: Jeffrey J. Lumetta, St. Petersburg, FL (US)

(73) Assignee: Jabil Circuit, Inc., St. Petersburg, FL (US)

( * ) Notice: Subject to any disclaimer, the term of this patent is extended or adjusted under 35 U.S.C. 154(b) by 0 days.

(21) Appl. No.: 13/559,009

(22) Filed: Jul. 26, 2012

(65) Prior Publication Data

US 2013/0027921 A1 Jan. 31, 2013

Related U.S. Application Data

(60) Provisional application No. 61/511,735, filed on Jul. 26, 2011.

(51) Int. Cl.

| | |
|---|---|
| ***F21V 29/00*** | (2015.01) |
| ***F21K 99/00*** | (2010.01) |
| ***F21V 23/00*** | (2015.01) |
| ***F21V 29/71*** | (2015.01) |
| *F21Y 101/02* | (2006.01) |

(52) U.S. Cl.

CPC . *F21V 29/20* (2013.01); *F21K 9/13* (2013.01); *F21V 23/001* (2013.01); *F21V 29/713* (2015.01); *F21K 9/90* (2013.01); *F21Y 2101/02* (2013.01); *Y10T 29/49002* (2015.01); *Y10T 29/4913* (2015.01)

(58) Field of Classification Search

CPC ..... F21V 29/26; F21V 29/262; F21V 29/265; F21K 9/10; F21K 9/13; F21K 9/137; F21K 9/1355

USPC ..... 362/373, 249.02, 294, 547; 313/46

See application file for complete search history.

(56) References Cited

U.S. PATENT DOCUMENTS

| | | | | |
|---|---|---|---|---|
| 4,267,559 | A | 5/1981 | Johnson et al. | |
| 5,942,907 | A * | 8/1999 | Chiang | 324/750.09 |
| 6,991,952 | B2 * | 1/2006 | Mizuno et al. | 438/26 |
| 7,872,273 | B2 * | 1/2011 | Lin et al. | 257/98 |
| 8,334,656 | B2 * | 12/2012 | Weiss | 315/33 |
| 8,513,866 | B2 * | 8/2013 | Breidenassel et al. | 313/46 |
| 8,525,396 | B2 * | 9/2013 | Shum et al. | 313/46 |
| 8,529,095 | B2 * | 9/2013 | Konaka | 362/294 |
| 8,540,401 | B2 * | 9/2013 | Simon et al. | 362/373 |

OTHER PUBLICATIONS

United States Publication No. 2010/0213808A1, published Aug. 26, 2010.

* cited by examiner

*Primary Examiner* — Alan Cariaso
*Assistant Examiner* — Mark Tsidulko
(74) *Attorney, Agent, or Firm* — Volpe and Koenig, P.C.

(57) ABSTRACT

A light emitting diode (LED) lighting assembly (200) includes an LED lighting source (223) and a heat sink assembly (209) that is configured between a power source and the LED light source (223) that works as an electrical conductor for the LED light source (223) and for removing heat generated by the LED light source (223).

33 Claims, 2 Drawing Sheets

LED LIGHTING ASSEMBLY HAVING ELECTRICALLY CONDUCTIVE HEAT SINK FOR PROVIDING POWER DIRECTLY TO AN LED LIGHT SOURCE

CROSS REFERENCE TO RELATED APPLICATION

This application claims priority to and the benefit of U.S. provisional patent application No. 61/511,735 filed on Jul. 26, 2011, entitled "LED LIGHTING ASSEMBLY HAVING ELECTRICALLY CONDUCTIVE HEAT SINK FOR PROVIDING POWER DIRECTLY TO AN LED LIGHT SOURCE," the entire contents of which are incorporated by reference.

FIELD OF THE INVENTION

The present invention relates generally to a light emitting diode (LED) lighting and more particularly to an LED lighting assembly having a heat sink for providing power to one or more LED light sources.

BACKGROUND OF THE INVENTION

High intensity spot and flood lamps, also known as luminaries, using light emitting diodes (LEDS) are now widely used in many different lighting applications. Like its incandescent and fluorescent counterparts, this type of high intensity lighting can efficiently illuminate objects and are used in landscaping, security, industrial, hospitality, household and entertainment settings. As compared to a conventional incandescent bulb, LEDs have a long life span and an excellent anti-shock performance in high power applications. Moreover, high luminance LED lighting can be more easily manufactured in many differing shapes, sizes, brightness and efficiency levels to fit a specific need. LED luminaries are more commonly available in all form factors ranging from the standard A19 household bulb to R150 bulbs used in street light and industrial locations.

One drawback in using high-luminance LED lighting is that it emits a high amount of heat. When used in large groups in a limited space, there are often difficulties in designing and applying the LED as a light source. Since the LED is a semiconductor device, if the heat dissipation efficiency of the luminary is low, the life span of the LEDs will be shortened. Obviously, this is undesirable since shorting the LED's life would defeat one of its primary benefits of using this type of light source. In order to maintain the life of the LED at expected levels, the LED die is generally kept below approximately 125 degrees Celsius. Thus, designing an LED luminary so that the LED die is maintained at a low temperature can be very challenging.

As seen in U.S. Pat. No. 8,089,085 issued Jan. 3, 2012 to Shi, heat pipes are often mounted at the sides of the LED die. The heat pipes and LED both connect to an aluminum substrate at the back of the light so that heat generated from the LEDs can more easily be dissipated. Since the heat is transferred through the heat pipes, this heated air within the pipes can then be further transferred to a heat dissipation cover. Although this type of secondary heat dissipation works to dissipate heat to the external air, there are also more effective ways in lowering heat generated by the LEDs to an acceptable level.

Further, prior art FIG. 1 illustrates a parabolic aluminized reflector (PAR) style bulb assembly 100 using LEDs where the bulb assembly has a potted base 101 that works to house an LED power supply driver 103. The base 101 includes a socket 105 that is used to connect within a threaded female AC connection for supplying power to the driver 103. A heat sink base 105 is attached to conical housing 107, which has a substantially truncated conical shape. The conical housing 107 is open at both ends and has a wide opening at its top end 109 for allowing insertion of a heat sink disk 111. The disk 111 includes one or more holes 113 substantially at its center for allowing wire conductors (not shown) originating at driver 103 to extend therethrough. These wire conductors pass though the disk 111 and are used to power an LED light source 115. The LED light source 115 is positioned centrally within a circular housing 117 and includes one or more LED die (not shown) that are used for connecting a plurality of LED semiconductor devices. When assembled, the circular housing 117 is mechanically connected with both the conical housing 107 and heat sink disk 111 for thermally conducting heat away from the LED light source 115. When used outdoors, these heat sink components may also be hermetically sealed for preventing moisture or other contamination from entering the inside of the heat sink assembly.

A problem associated with this type of LED lighting assembly is the complex mechanical nature of housing having various components and pieces that must be separately manufactured and assembled. Those skilled in the art will recognize that other more efficient lighting designs are possible for more effectively removing heat while still maintaining a low manufacturing cost.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
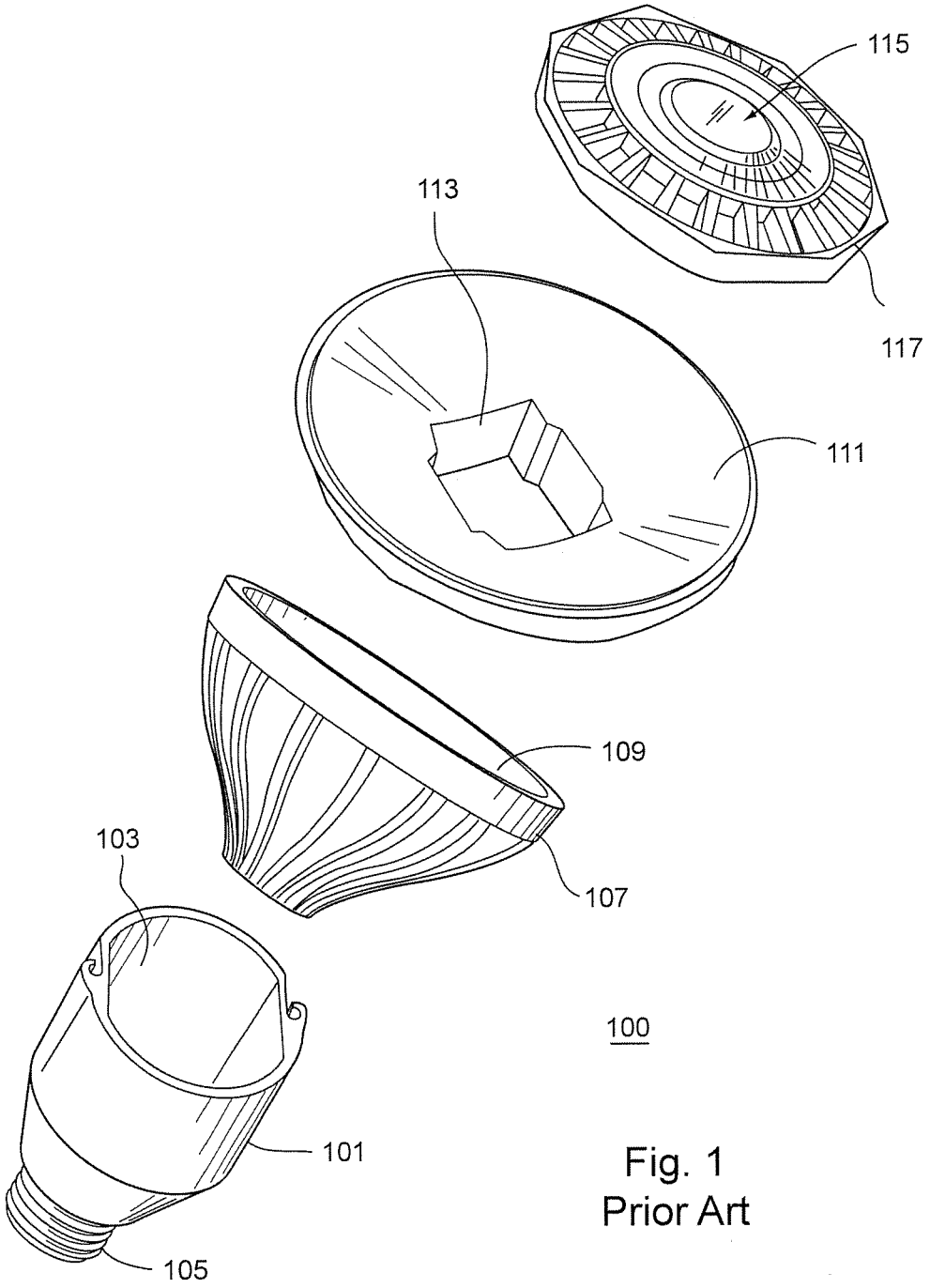
Fig. 1 Prior Art
FIG. 1 illustrates an exploded view of a heat sink assembly used in the prior art.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an LED lighting assembly having a conductive heat sink for acting as an electrical conductor for providing power to an LED light source. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIGS. 2, 2A, 2B and 2C illustrate a new LED lighting assembly using a heat sink for providing power to one or more LED light sources in accordance with an embodiment of the invention. The LED lighting assembly 200 includes a potted base 201 having a threaded lamp connector that is used for supplying AC power to a power supply driver 205. The driver 205 is typically mounted on a printed circuit (PC) board and is housed within the base 201. The driver 205 includes one or more electrical components mounted thereon for converting an AC line voltage, supplied though the threaded lamp connector, to DC power at some predetermined voltage and current. The driver 205 also includes one or more electrical conductors 207 extending therefrom for supplying the DC output power. The electrical conductors 207 are used for electrically connecting to a heat sink assembly as described herein. Although shown using wire conductors, those skilled in the art will recognize that respective portions of the driver 205 may be configured so as to be in direct electrical contact with an electrically conductive heat sink. Although not shown herein, this would enable the driver 205 to supply a voltage and current without the use of electrical conductors 207.

Figure 2:
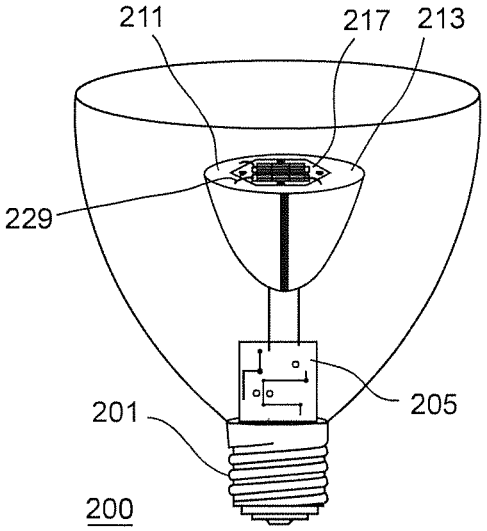
FIGS. 2, 2A, 2B and 2C illustrate an LED lighting assembly having a heat sink for providing power to the LED light source in accordance with an embodiment of the invention.
Figure 2A:
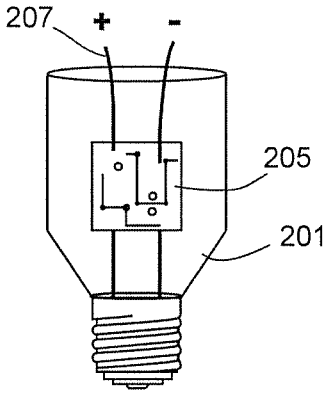
Figure 2B:
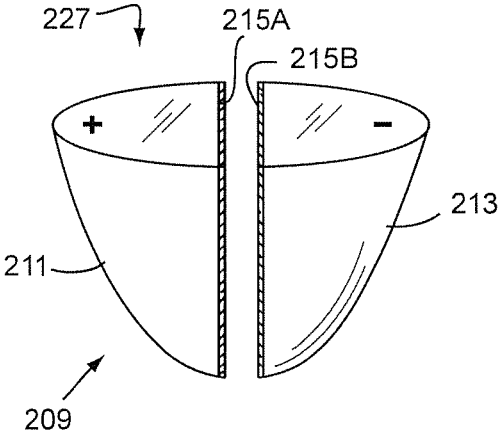

FIG. 2B illustrates a heat sink assembly 209 that preferably comprises a first wedge 211 and a second wedge 213 that form the respective halves or complementary pieces of the assembly 209. Although referred herein as "wedge," other analogous terms such as portion, section or segment could also be used. The first wedge (or first portion) 211 and the second wedge (or second portion) 213 are formed of an electrically and thermally conductive material, such as a metal or conductive polymer, for allowing each of the heat sink wedges to act as an electrical conductor. When assembled, the first wedge 211 and second wedge 213 work as electrical conductors for providing power directly from the driver 205 to one or more LED die and/or light sources as described herein. An electrically isolative material 215A, 215B is positioned between the first wedge 211 and second wedge 213 for providing isolation to prevent electrical contact therebetween as each is used for conducting a different voltage polarity (+/−). The electrically isolative material 215A, 215B will preferably also be thermally conductive so as to allow heat to be transferred between the first wedge 211 and second wedge 213 when in their assembled states. Although separate pieces of electrically isolative material 215A, 215B are shown in FIG. 2B, it will be also evident to those skilled in the art that a single substrate of electrically isolative material may be used directly between the first wedge 211 and second wedge 213 for providing electrical isolation. Moreover, although illustrated as wedges forming a truncated conical bulb-like shape, other shapes such as discs, cubes, and cones are also within the spirit and scope of the invention.

Figure 2C:
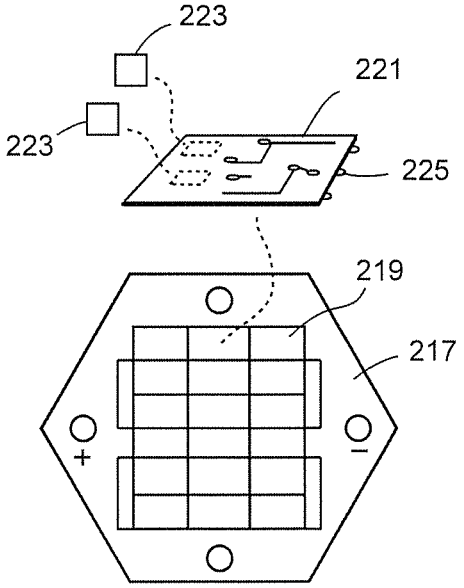

FIG. 2C illustrates a magnified view of main and sub-board assembly. Both the main circuit board 217 and one or more sub-boards 221 are printed circuit boards that are manufactured from thermal conductive materials such as aluminum or fiber reinforced epoxy laminate (FR-4). These materials operate to remove or "sink" heat away from LEDs and other components mounted thereon. The main board 217 may include a plurality of plated pads 219 or the like for allowing one or more sub-boards 221 to be mounted thereon. Although FIG. 2C illustrates only one sub-board 221, it should be evident to those skilled in the art that the main board 217 will preferably be configured to allow a plurality of sub-boards 221 to be mounted thereon. In many lighting applications, it is not uncommon to see up to 40 sub-boards 221 mounted on the main board 217.

Each sub-board 221 includes one or more semiconductor devices for providing illumination such as LEDs 223 or the like. As is well known in the art, when the LED 223 is forward biased (switched on), electrons are able to recombine with electron holes within the device, releasing energy in the form of photons. This effect is called electroluminescence and the color of the light (corresponding to the energy of the photon) is determined by the energy gap of the semiconductor. In this type of application, the preferred color of the LED is white. Each sub-board can include a plurality of solder pads 225 or ball pads that form a ball grid array (BGA) type connection for making an electrical connection to the plated pads 219 on the main board 217. A plurality of thermal pads may also be used below the sub-board 221 to promote thermal conductivity. In an alternative embodiment, the LED die can be soldered directly to the heat sink without the use of a main circuit board or sub-board 221.

When assembled, heat generated by the LED 223 will sink away from the LED through the sub-board 221 to the main board 217. The main board 217 is both electrically and thermally connected with a top portion 227 of the first wedge 211 and second wedge 213. The main board 217 is electrically connected in a manner so the respective polarity of each wedge 211, 213 is attached with the main board 217. When in its assembled state, power supplied by the driver board 205 is supplied through the first wedge 211 (+) and second wedge 213 (−) to electrical conductors on the bottom of the main board 217. Those skilled in the art will appreciate that both the first wedge 211 and second wedge 213 have multiple functionality by acting as both an electrical conductor and a thermal conductor. The first wedge 211 and second wedge 213 eliminate the need for a wired connection but also remove heat away from the LEDs 223 mounted on the one or more of the sub-board(s) 221.

Thus, FIG. 2 illustrates the LED lighting assembly in its assembled condition showing the driver board 205 electrically connected with the first wedge 211 and second wedge 213. The main board 217 is shown in an alternative embodiment with one or more wire conductors 229 electrically connecting the main board 217 to the first wedge 211 and second wedge 213, respectively. The first wedge 211 and second wedge 213 can be joined to form a housing shell of the lighting assembly or alternatively an outer cover may also be used over the first wedge 211 and second wedge 213 for protecting the heat sink wedge assembly 209 from damage. Various embodiments of the invention present advantages over the prior art since manufacturing and assembly can be greatly simplified through the use of a multifunctional heat sink operating both as an electrical conductor and thermal conductor.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A light emitting diode (LED) lighting assembly comprising:

at least one LED lighting source; and at least one heat sink configured between a power source and the at least one LED lighting source that acts both as an electrical and thermal conductor for providing power to the at least one LED light source and for removing heat generated by the LED light source;

wherein the at least one heat sink includes first and second portions that are thermally conductive and electrically conductive and that are electrically isolated from one another but thermally coupled to one another, the first and second portions being electrically coupled, respectively, to first and second electrical inputs of the LED light source.

2. An LED lighting assembly as in claim 1, wherein the electrically isolated sections each have at least one shape from the group of wedge, disc or block.

3. An LED lighting assembly as in claim 1, wherein the at least one LED lighting source is mounted to a printed circuit board.

4. An LED lighting assembly as in claim 3, wherein the printed circuit board is electrically connected to the at least one heat sink.

5. An LED lighting assembly as in claim 1, wherein the at least one LED light source is a bare semiconductor die mounted directly to the at least one heat sink.

6. An LED lighting assembly as in claim 1, wherein the LED lighting assembly has a form factor of a parabolic aluminized reflector (PAR) 38 bulb.

7. A light assembly, comprising:

an LED light source having first and second electrical inputs;

a heat sink having first and second portions that are thermally conductive and electrically conductive, and that are electrically isolated from each other but thermally coupled to one another, the first and second portions being electrically coupled, respectively, to the first and second electrical inputs of the LED light source; and driver circuitry electrically coupled to the LED light source via the first and second portions of the heat sink;

wherein the LED light source is mounted onto said first and second portions of said heat sink.

8. A light assembly as in claim 7, wherein the first and second portions each have at least one shape from the group of wedge, disc or block.

9. A light assembly as in claim 7, wherein said LED light source includes at least one LED mounted to a printed circuit board.

10. A light assembly as in claim 9, wherein the printed circuit board is electrically connected to the heat sink.

11. A light assembly as in claim 7, wherein the LED light source includes a bare semiconductor die mounted directly to the heat sink.

12. A light assembly as in claim 7, wherein the light assembly has a form factor of a parabolic aluminized reflector (PAR) 38 bulb.

13. A method for forming a light emitting diode (LED) lighting assembly comprising:

providing at least one LED lighting source; and configuring at least one heat sink between a power source and the at least one LED lighting source that acts both as an electrical and thermal conductor for providing power to the at least one LED light source and for removing heat generated by the at least one LED light source;

wherein, the at least one heat sink includes electrically and thermally conductive portions electrically isolated from one another and thermally coupled to one another.

14. A method for forming an LED lighting assembly as in claim 13, further comprising the step of:

configuring the electrically isolated sections into a shape from one of the group of wedge, disc or block.

15. A method for forming an LED lighting assembly as in claim 13, further comprising the step of:

mounting the at least one LED lighting source to a printed circuit board (PCB).

16. A method for forming an LED lighting assembly as in claim 13, further comprising the step of:

configuring the at least one LED light source as a bare semiconductor die mounted directly to the at least one heat sink.

17. A method for forming an LED lighting assembly as in claim 13, further comprising the step of:

configuring the LED lighting assembly into a parabolic aluminized reflector (PAR) 38 bulb form factor.

18. A light emitting diode (LED) lighting assembly comprising:

at least two electrically and thermally conductive heat sink portions electrically isolated from one another but thermally coupled to one another; and an LED light source mounted onto and thermally coupled to said at least two electrically and thermally conductive heat sink portions to remove heat from said LED light source;

wherein said LED light source is electrically coupled to receive electrical power from said at least two electrically and thermally conductive heat sink portions.

19. An LED lighting assembly as in claim 18, wherein said LED light source includes a thermally conductive main circuit board electrically and thermally coupled to said at least two electrically and thermally conductive heat sink portions.

20. An LED lighting assembly as in claim 19, wherein said LED light source further includes a plurality of sub-boards mounted to corresponding pads provided on said main circuit board, and wherein at least one LED is mounted to each sub-board.

21. An LED lighting assembly as in claim 20, wherein each sub-board includes a plurality of solder pads for making electrical connection to said pads of said main circuit board.

22. An LED lighting assembly as in claim 20 and further comprising at least one thermal pad provided below each sub-board to promote thermal conductivity.

23. An LED lighting assembly as in claim 18 and further comprising an electrically isolative material disposed between said at least two electrically and thermally conductive heat sink portions.

24. An LED lighting assembly as in claim 23, wherein said electrically isolative material is thermally conductive.

25. An LED lighting assembly as in claim 18, wherein said at least two electrically and thermally conductive heat sink portions each have at least one shape selected from the group of wedge, disc or block.

26. An LED lighting assembly as in claim 18 and further comprising a potted base having a threaded lamp connector.

27. An LED lighting assembly as in claim 26 and further comprising a power supply driver, wherein said threaded lamp connector provides AC power to said power supply driver, which converts the AC power to DC output power.

28. An LED lighting assembly as in claim 27, wherein said power supply driver supplies the DC output power to said LED light source through said at least two electrically and thermally conductive heat sink portions.

29. An LED lighting assembly as in claim 18, wherein said LED light source comprises a bare semiconductor die mounted directly to said at least two electrically and thermally conductive heat sink portions.

30. An LED lighting assembly as in claim 18, wherein said LED lighting assembly has a form factor of a parabolic aluminized reflector (PAR) 38 bulb.

31. An LED lighting assembly as in claim 18 and further comprising:

a potted base having a threaded lamp connector; and a power supply driver, wherein said LED light source includes a thermally conductive main circuit board that is electrically and thermally coupled to said at least two electrically and thermally conductive heat sink portions, and wherein said threaded lamp connector provides AC power to said power supply driver, which converts the AC power to DC output power, and supplies the DC output power to said LED light source through said at least two electrically and thermally conductive heat sink portions and said main circuit board.

32. An LED lighting assembly as in claim 18, wherein said at least one LED lighting source is mounted to a printed circuit board.

33. An LED lighting assembly as in claim 32, wherein said printed circuit board is electrically connected to said at least one heat sink.

* * * * *